US007664286B2

(12) United States Patent
Akino

(10) Patent No.: US 7,664,286 B2
(45) Date of Patent: Feb. 16, 2010

(54) CAPACITOR MICROPHONE

(75) Inventor: Hiroshi Akino, Machida (JP)

(73) Assignee: Kabushiki Kaisha Audio-Technica, Machida-shi (JP)

( * ) Notice: Subject to any disclaimer, the term of this patent is extended or adjusted under 35 U.S.C. 154(b) by 820 days.

(21) Appl. No.: 11/302,205

(22) Filed: Dec. 14, 2005

(65) Prior Publication Data

US 2006/0133626 A1 Jun. 22, 2006

(30) Foreign Application Priority Data

Dec. 17, 2004 (JP) ..... 2004-366873

(51) Int. Cl.
*H04R 25/00* (2006.01)

(52) U.S. Cl. ..... 381/361; 381/174; 381/189

(58) Field of Classification Search ..... 381/355, 381/360, 361, 362, 369, 92, 122, 174, 189; 439/95, 106, 610, 620.21
See application file for complete search history.

(56) References Cited

U.S. PATENT DOCUMENTS 2,579,162 A * 12/1951 Veneklasen ..... 381/174
4,261,628 A * 4/1981 Gallagher et al. ..... 439/95
7,104,844 B2 * 9/2006 Akino ..... 439/620.21
7,517,234 B2 * 4/2009 Akino ..... 439/106

FOREIGN PATENT DOCUMENTS

JP 11-155198 6/1999
JP 2002-152892 5/2002

* cited by examiner

*Primary Examiner*—Huyen D Le
(74) *Attorney, Agent, or Firm*—Oblon, Spivak, McClelland, Maier & Neustadt, L.L.P.

(57) ABSTRACT

A capacitor microphone in which a microphone case is made of a conductive material, has a microphone case connector connecting a cable connector at one end of a microphone cable to an internal circuit of a microphone, and is in electrical connection with the cable connector, and in which a conductive and elastic plate-like member is provided at a bottom of the microphone case connector, and is wedged by the cable connector and the microphone case connector. The cable connector and the microphone case connector being electrically connected via the conductive and elastic plate-like member.

7 Claims, 4 Drawing Sheets

CAPACITOR MICROPHONE

CROSS REFERENCE TO RELATED APPLICATION

This application is based upon and claims the benefit of priority from the prior Japanese Patent Application No. 2004-366873 filed on or around Dec. 17, 2004, the entire contents of which are incorporated herein as reference.

BACKGROUND OF THE INVENTION

The invention relates to a capacitor microphone, and more particularly relates to capacitor microphone having a shield structure and a looseness-preventing structure for an output connector.

DESCRIPTION OF THE RELATED ART

A capacitor microphone usually has high impedance in a microphone unit, and includes an impedance transducer constituted by an FET (field effect transistor). The impedance transducer transduces the impedance to low impedance. A microphone is connected to a balanced shield cable as an output cable, converts a voice signal, and sends the converted voice signal via the balanced shield cable.

If strong electro-magnetic waves come into the output cable of the microphone, they reach the microphone via a microphone connector, and cause audio frequency noises. Especially, high frequency currents coming in the capacitor microphone are demodulated by the impedance transducer, and are mixed into a microphone output as audible frequency noises.

At present, as cellular phones are in wide use, high frequency electromagnetic waves are abundant everywhere, come into the microphone via the microphone cable or connector, and often cause noises in voice signals. Especially, with the capacitor microphone, high frequency signals arriving via the connector tend to cause noises.

Generally speaking, the microphone cable is detachably connected to the microphone using a microphone connector and a cable connector. Each of the connectors is a 3-pin connector, i.e., specified by EIAJ RC5326, "Latch-Lock type Round Connector". In the 3-pin microphone connector, No. 1 pin is for grounding, No. 2 pin is used as a hot-side of a signal, and No. 3 pin is used as a cold-side of the signal. A microphone case connector into which the cable connector is fitted is a part of the microphone case or is electrically integral with the microphone case, and serves as a shield for the microphone. The cable connector is electrically connected to the microphone case.

According to the foregoing EIAJ microphone code and standard, a conductor connected to the microphone case from No. 1 pin functions as an antenna or a common impedance. It is well-known that a high frequency currents flowing to the connector cause noises. Usually, the conductor connecting No. 1 pin and the microphone case is positioned in the microphone case. If the conductor is long, it induces a high frequency current in an electronic circuit in the microphone case, and tends to cause noises extensively.

Further, there is a slight space around the microphone case connector. When the microphone and a cord connector are relatively moved, they will produce mechanical rattles or electrical noises due to contact failure. Up to now, a cushion has been put in the microphone in order to overcome the foregoing problem. However, such a cushion cannot suppress noises caused by high frequency currents.

Japanese Patent Laid-Open Publications No. 2002-152892 and No. Hei 11-155198 have proposed to prevent noises caused by high frequency signals. In these publications, a microphone body is covered by a cylindrical shield. However, a shield for a connector has not been treated as important up to now. Even if entirely covered by a shield case, the microphone cannot be protected against electromagnetic waves coming in via the connector. Therefore, it is impossible to prevent high frequency signal noises induced by electromagnetic waves from being mixed into the voice signal. Neither of the foregoing references disclose a structure which serves as a shield and looseness-preventing unit.

SUMMARY OF THE INVENTION

The invention has been contemplated in order to overcome the foregoing problems of the related art, and is intended to provide a capacitor microphone which includes a shield for a microphone connector in order to prevent noises caused by high frequency signals, and a structure enabling a microphone case and connector to be in close contact with each other and to reduce mechanical rattles.

The invention is easily applicable to existing microphones, and prevents noises caused by high frequency signals and mechanical rattles.

In accordance with an aspect of the invention, there is provided a capacitor microphone in which a microphone case is made of a conductive material, has a microphone case connector connecting a cable connector at one end of a microphone cable to an internal circuit of a microphone, and is in electrical connection with the cable connector, and in which a conductive and elastic plate-like member is provided at a bottom of the microphone case connector, and is wedged by the cable connector and the microphone case connector. The cable connector and the microphone case connector are electrically connected via the conductive and elastic plate-like member.

When attached to the microphone case connector, the cable connector and the microphone case connector become conductive. Further, the conductive and elastic plate-like member becomes conductive with the cable connector and the microphone case. The conductive and elastic plate-like member serves as the shield, and blocks high frequency current coming into the internal circuit via the microphone case connector, so that the capacitor microphone can reliably operate with an excellent signal-to-noise ratio. The conductive and elastic plate-like member is compressed when the cable connector is attached to the microphone case connector, so that the cable connector and the microphone case connector do not produce mechanical rattles, and are free from contact failure. The capacitor microphone is free from noises caused by the contact failure.

DETAILED DESCRIPTION OF THE INVENTION

Figure 1:
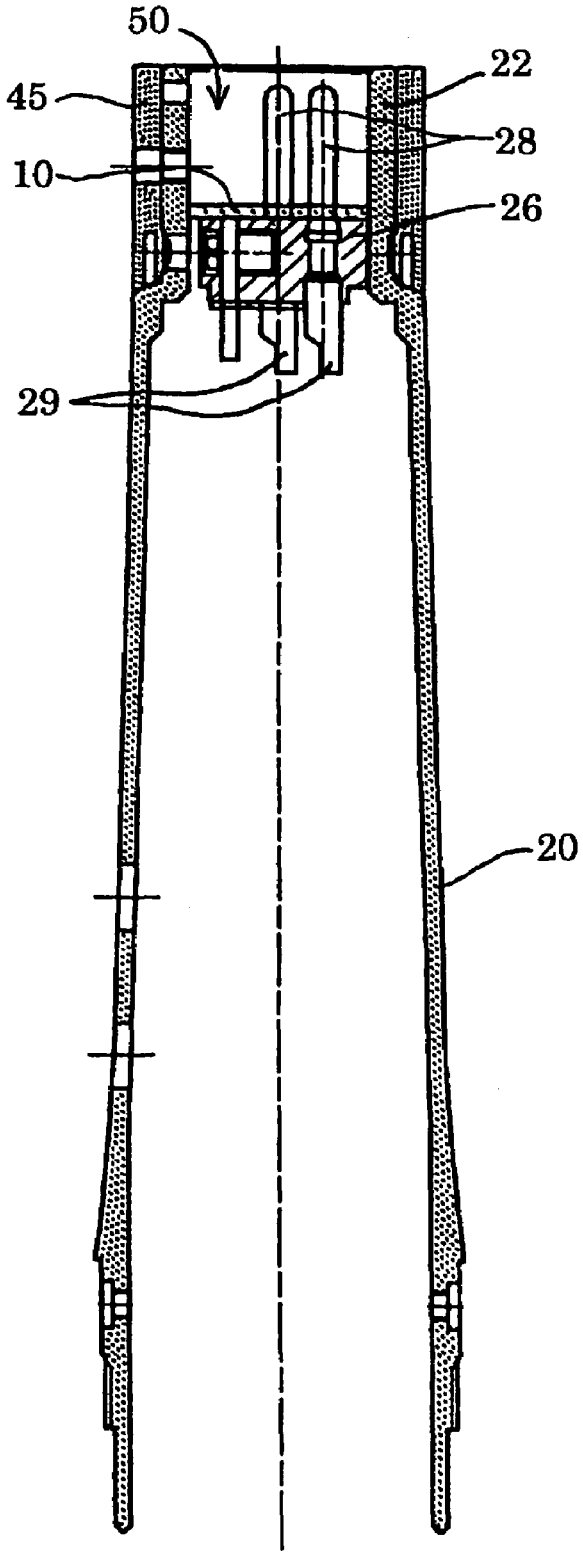
FIG. 1 is a longitudinal section of an essential part of a capacitor microphone according to the invention.
Figure 2:
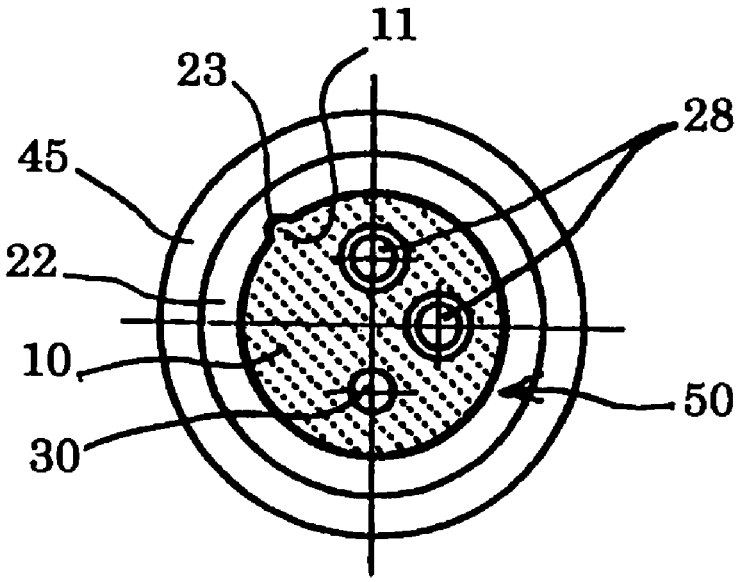
FIG. 2 is a top plan view of a connector of the capacitor microphone.
Figure 3:
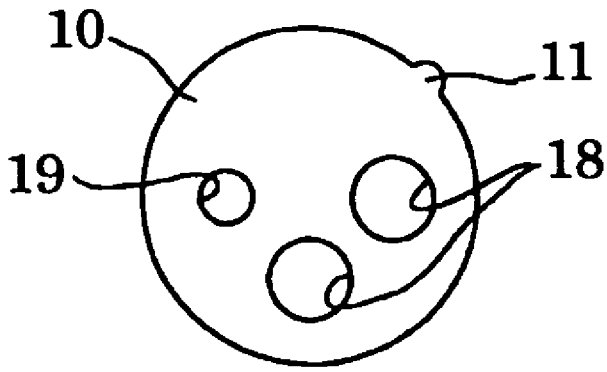
FIG. 3 is a top plan view of a conductive and elastic disc of the capacitor microphone.
Figure 4:
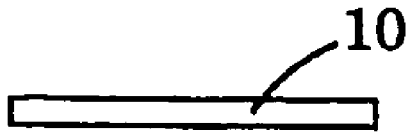
FIG. 4 is a side elevation of the conductive and elastic disc.

Referring to FIG. 1 and FIG. 2, a microphone case 20 has a small base 22 compared to a main part thereof. A microphone case connector 50 is present at the base 22, receives a cable connector and connects it to an internal circuit of a microphone. The cable connector is provided at an end of a microphone cable (not shown). The connector 50 includes a holder 26 and three pins passing through the holder 26. The holder 26 has an insulator which is fitted in the base 22 and across the microphone case 20. The three pins meet the code and standard of EIAJ RC-5236. No. 1 pin 30 is used for grounding, No. 2 pin 28 is a hot-side of a signal, and No. 3 pin 28 is a cold-side of the signal. The pin 30 is thinner than the pins 28. The three pins 30 and 28 are arranged along the periphery of the microphone case 20 as specified in the foregoing code and standard.

In the holder 26, connectors 29 integral with the pins 28 extend toward the interior of the microphone case 20, and are connected to wiring patterns of a circuit board (positioned in the microphone case 20 but not shown) using conductors. A capacitor microphone unit is provided in a front end of the microphone case 20 (at a lower part in FIG. 1). A windshield is attached to the front end of the microphone case 20, and extends over the microphone unit. A cover 45 is attached on an outer surface of the base 22 of the microphone case 20.

When the cable connector is fitted into the connector 50 of the microphone case 20, a microphone cable connector case and pin 30 are electrically connected to a microphone cable shield. A cable connector case is in contact with the base 22, and is electrically connected to the microphone case 20. Therefore, the microphone case 20 is also shielded against electromagnetic waves from an external source.

The capacitor microphone features that an elastic and conductive disc 10 is provided on the bottom of the microphone case connector 50 in the microphone case 20, i.e., across the holder 26. The disc 10 is made of thin conductive wires woven in the shape of a fabric. A conductive woven fabric, e.g., SUI-78-5010T manufactured by Taiyou Wire Netting Kabushiki Kaisha is on the market. The conductive woven fabric is regularly and three dimensionally woven according to the foregoing code and standard, and is elastic. Alternatively, thin conductive wires may be irregularly folded in the shape of an elastic sheet.

In this embodiment, the disc 10 is made by punching a conductive fabric, and has openings 18 and 19 at positions corresponding to the pins 28 and 30, and a positioning ledge 11 sticking outward. The opening 18 are for the No. 2 and No. 3 pins 28 while the opening 19 is for No. 1 pin 30. The opening 19 is smaller than the openings 18. When the disc 10 is in the holder 26, the periphery of the opening 19 is in contact with No. 1 pin 30. The openings 18 are larger than No. 2 and No. 3 pins 28. The positioning ledge 11 is registered by the inner surface of the microphone connector 50 of the microphone case 20, and is fitted into a slit 23 in the microphone connector 50.

When the microphone cable connector is fitted into the microphone case connector 50, a female case of the microphone case connector 50 is engaged with a male case of the microphone cable connector 50 and becomes conductive. No. 1 to No. 3 pins of the microphone case connector 50 are received in openings in the cable connector, and become conductive. The connectors are effectively shielded by engagement of the female and male cases. However, as described with respect to the related art, electromagnetic waves coming in from an external source induce high frequency currents at the conductors of the connectors, and cause high frequency current noises. Therefore, the foregoing shield structure cannot prevent noises. In the related art, no measures have been taken against electromagnetic waves coming from cellular phones when they were not as popular as at present.

In accordance with the invention, the conductive disc 10 is positioned at the bottom of and across the microphone case connector 50, and is electrically connected to the cases of the microphone case connector 50 and of the cable connector. Further, the cases are electrically connected to the shield of the microphone cable. Therefore, the conductive disc 10 can effectively block electromagnetic waves coming in via the microphone case connector 50 even when there are a lot of electromagnetic waves. When applied to the capacitor microphone whose microphone unit has high impedance, the invention can realize a microphone which is not affected by electromagnetic waves and has a good signal to noise ratio.

The conductive elastic disc 10 is compressed and stores repulsive force when it is wedged in the microphone connector 50 with which the cable connector is fitted. The repulsive force of the conductive elastic disc 10 enables the foregoing connectors to be closely and mechanically engaged. This is effective in reducing mechanical rattles, contact failure and generation of noises due to the contact failure.

The present invention is applicable to any kinds of microphones, and is most preferable when it is applied to capacitor microphones which are easily affected by electromagnetic waves. Therefore, the present invention is described with respect to the capacitor microphone. However, the invention is applicable not only to general purpose but also to professional use capacitor microphones. Further, existing capacitor microphones can enjoy the advantage of the present invention by attaching the conductive elastic disc.

What is claimed is:

1. A capacitor microphone comprising:

a microphone case made of a conductive material;

a microphone case connector configured to connect a cable connector at one end of a microphone cable to an internal circuit of the capacitor microphone, the microphone case connector being electrically connected to the cable connector;

a conductive and elastic disc provided at a bottom of the microphone case connector, the conductive and elastic disc being wedged by the cable connector and the microphone case connector, the cable connector and the microphone case connector being electrically connected via the conductive and elastic disc.

2. The capacitor microphone of claim 1, wherein the conductive and elastic disc is in contact with a grounding pin of the microphone case connector and is spaced away from other pins.

3. The capacitor microphone of claim 1, wherein the conductive and elastic disc is made of conductive thin wires woven in the shape of a fabric.

4. The capacitor microphone of claim 1, wherein the conductive and elastic disc includes a positioning part at a peripheral edge thereof, the positioning part being engaged with a positioning member of the microphone case connector, the positioning part positioning the conductive and elastic disc.

5. The capacitor microphone of claim 4, wherein a peripheral edge of the conductive and elastic disc is registered by an inner wall of the microphone case connector.

6. The capacitor microphone of claim 1, wherein the microphone case is connected to a shield wire via the cable connector and the microphone case connector.

7. The capacitor microphone of claim 1, wherein the conductive and elastic disc is positioned at the bottom and across the microphone case connector.

* * * * *